United States Patent [19]

Opitz et al.

[11] 4,087,497

[45] May 2, 1978

[54] COOLING DEVICE

[75] Inventors: Wolfgang Opitz; Otto Bühring; Hans Hennen, all of Hurth, Germany

[73] Assignee: Hoechst Aktiengesellschaft, Frankfurt am Main, Germany

[21] Appl. No.: 796,211

[22] Filed: May 12, 1977

[30] Foreign Application Priority Data

May 15, 1976 Germany ..... 2621718

[51] Int. Cl.[2] ..... B01F 3/04

[52] U.S. Cl. ..... 261/118; 23/252 A; 55/228; 55/435; 208/48 Q; 261/DIG. 9

[58] Field of Search ..... 261/94, 115, 116, 118, 261/112, DIG. 9, DIG. 54; 208/48 Q; 23/277 R, 277 C, 284, 252 A; 202/227, 228; 55/228, 435

[56] References Cited

U.S. PATENT DOCUMENTS

| | | | |
|---|---|---|---|
| 2,116,748 | 5/1938 | Carter | 261/118 |
| 3,133,014 | 5/1964 | Cross, Jr. | 208/48 Q X |
| 3,268,296 | 8/1966 | Hall et al. | 261/94 X |
| 3,330,231 | 7/1967 | Spencer | 261/DIG. 9 |
| 3,414,247 | 12/1968 | Sama | 261/118 |
| 3,577,709 | 5/1971 | Hoad | 55/228 |
| 3,593,968 | 7/1971 | Geddes | 23/284 X |
| 3,712,796 | 1/1973 | Sansom et al. | 261/DIG. 54 |
| 3,758,081 | 9/1973 | Prudhon | 23/252 A X |
| 3,888,955 | 6/1975 | Maruko | 261/DIG. 9 |
| 3,959,420 | 5/1976 | Geddes et al. | 261/DIG. 54 |

*Primary Examiner*—Tim R. Miles
*Assistant Examiner*—Richard L. Chiesa
*Attorney, Agent, or Firm*—Connolly and Hutz

[57] ABSTRACT

A cooling device for use in the quenching of combustion gases containing hydrogen chloride. The device is an elongated steel vessel with angularly spaced openings to receive nozzles for the injection of a quenching liquid. The vessel contains a hard rubber layer extending over its inner surface and an acid-resistant ceramic lining within the hard rubber layer.

7 Claims, 1 Drawing Figure

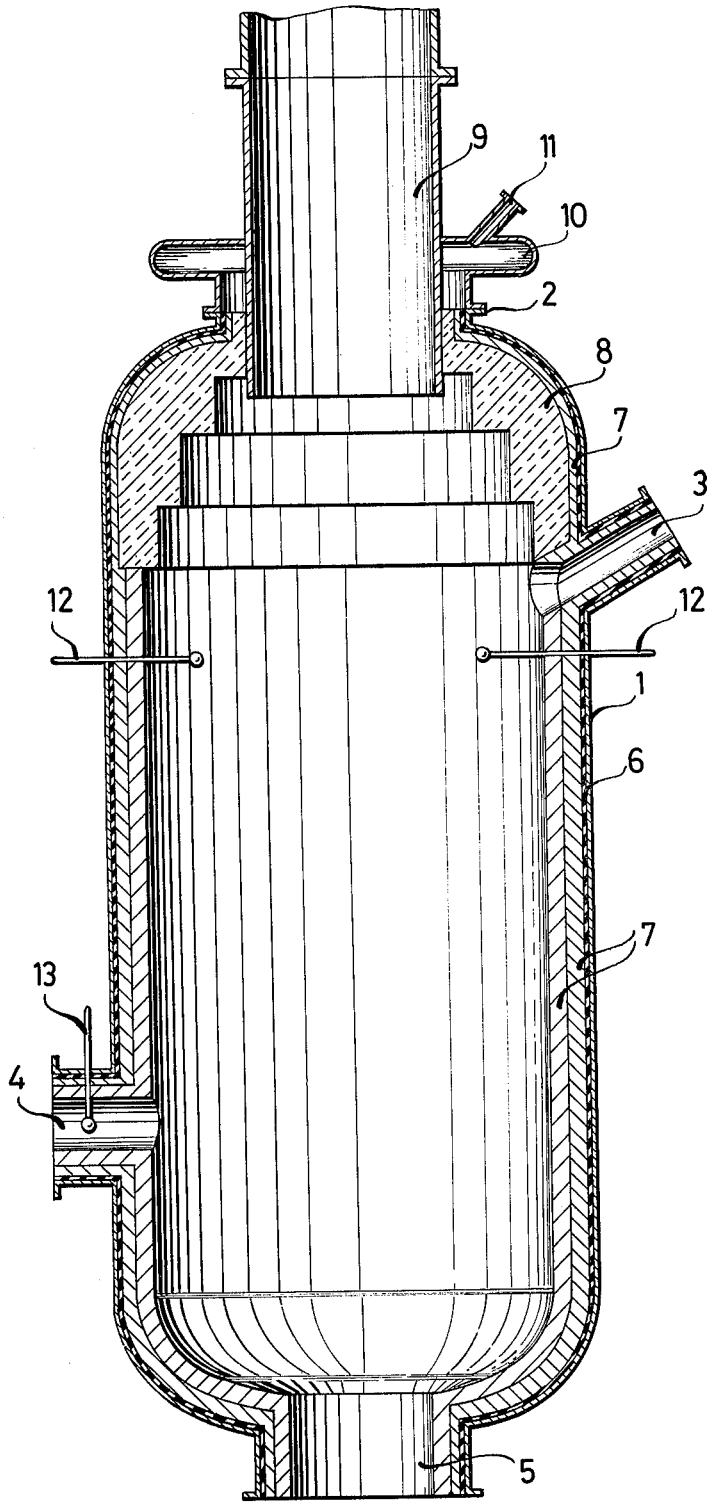
9
11
10
2
8
7
3
12
12
1
6
7
13
4
5

COOLING DEVICE

This invention relates to a cooling device ("a quench") suitable for use in the quenching of hot highly corrosive combustion gases containing hydrogen chloride, particularly those which are formed in the combustion of waste gases together with liquid residues, both the gases and the liquid residues containing one or more chlorinated hydrocarbons.

The part of a combustion installation which is the most difficult to design and construct, and the most liable to fail, is the steel quench vessel in which the hot combustion gases are commonly quenched. A quench vessel is usually operated not only above but also below the dew point of the combustion gases and of the evaporating quenching liquid injected into the vessel, which may for example be water or hydrochloric acid; it is desirable that the vessel should accordingly be made heat-resistant in the region of the hot combustion gases, and acid-resistant in the region where the temperature may fall below the above-mentioned dew point. Hitherto there has been difficulty in meeting these requirements in practice, so that the quench vessel rapidly corroded even if it was lined with refractory bricks in the region of the hot combustion gases, that is to say above the inlet for the quenching liquid, and with acid-resistant ceramic plates in the region where the temperature might fall below the dew point, that is to say below the inlet for the quenching liquid. Protection against this corrosion may be adequate for the quenching of combustion gases resulting from the combustion of liquid residues of chlorinated hydrocarbons, since uniform metering can here make possible an at least approximate demarcation between hot and quenched combustion gases. However, in the combustion of waste gases containing chlorinated hydrocarbons, and in fact even in their conjoint combustion with liquid residues of chlorinated hydrocarbons, the operating conditions may be such that momentary fluctuations of flow and temperature do occur, with the result that the temperature distribution within the quench vessel is liable to be considerably displaced, so that either excessively high or insufficiently high temperatures may occur in certain regions.

It is an object of the present invention to provide a cooling device enabling these difficulties to be at least partially overcome.

According to the present invention, we provide a cooling device suitable for use in the quenching of combustion gases containing hydrogen chloride, which device comprises: an elongated steel vessel having rounded end portions, these being, in use, top and bottom end portions; a generally axial gas-admitting connection provided on the (in use) top end portion of the vessel; three to eight inclined connections disposed at substantially uniform angular intervals around a substantially horizontal zone situated in the top third of the vessel (referring to its orientation when in use), below the rounded top end portion, which connections, in use, receive nozzles for the injection of a quenching liquid circulated around a closed circuit; a lateral connection in the lower third of the vessel (referring to its orientation when in use), above the rounded bottom end portion, providing, in use, an outlet for quenched combustion gases and quenching liquid; a generally axial connection provided on the (in use) bottom end portion of the vessel, whereby assembly, repair, and cleaning operations are facilitated and/or an outlet is provided, in use, for quenching liquid; a hard rubber layer extending over the inner surfaces of the vessel and of the three to eight inclined connections and of the three other connections; an acid-resistant lining within the hard rubber layer; a refractory lining of heat insulating-bricks within the acid-resistant lining in the region above (in use) the three to eight inclined connections; a tube of corrosion-resistant steel inserted into the connection on the (in use) top end portion of the vessel; a steel compensator surrounding this inserted tube and surmounting the connection on the (in use) top end portion, whereby a seal is provided at that end of the vessel and compensation is provided for thermal expansion of the said inserted tube; and an inlet pipe connected to the steel compensator whereby, in use, an inert gas protecting its inner surface against corrosion can be admitted.

The cooling device of the invention preferably exhibits one or more of the following features:

(a) the said acid-resistant lining, below the said inclined connections, comprises a double layer of ceramic liner plates in acid-resistant mortar;

(b) the said acid-resistant lining, in and above the said zone, consists of a single layer of ceramic pieces laid in acid-resistant mortar;

(c) the said refractory lining comprises heat-insulating bricks laid in refractory mortar, and has a maximum thickness in the rounded region of the vessel which is situated, in use, above the said inclined connections;

(d) the vessel has a height-to-diameter ratio of 1.5:1 to 3:1;

(e) in the (in use) top third of the vessel, there are disposed, beneath the zone of the said inclined connections, two temperature sensors, the arrangement being such that the supply of combustion gases to the vessel is interrupted in the event of the temperature sensed by either sensor exceeding a predetermined temperature in the range of 100° to 200° C;

(f) a temperature sensor is disposed in the said lateral connection, the arrangement being such that the supply of combustion gases to the vessel is interrupted in the event of the temperature sensed by this sensor exceeding a predetermined temperature in the range of 70° to 140° C.

A cooling device according to the present invention is shown in vertical section in the single FIGURE of the accompanying drawing. This FIGURE is diagrammatic, however, more particularly in that it is not drawn to a strictly uniform scale, its proportions being varied where necessary for the sake of clarity.

The cooling device shown in the FIGURE preferably has a height which amounts to approximately twice its diameter. The device comprises a generally cylindrical steel vessel 1 rounded at its ends, which at the top carries a central connection 2 to receive an inserted NCT tube 9 of corrosion resistant steel, through which combustion gases containing hydrogen chloride enter at a temperature of about 1000° C. In the top third of the vessel, three to eight inclined connections 3 are disposed in one plane at equal angular intervals from one another, these inclined connections receiving downwardly and inwardly directed nozzles for the injection of quenching liquid, preferably water or hydrochloric acid. Adequate and rapid cooling of the combustion gases is thereby made possible even in the event of fluctuating heat contents of these gases.

In the bottom third of the vessel a straight lateral connection 4 is provided as an outlet aperture for the quenched combustion gases and part of the heated quenching liquid. A central connection 5 provided at the bottom facilitates assembly, repair, and cleaning operations, and also serves as an outlet aperture for quenching liquid collecting in the bottom of the vessel.

Because the temperatures may everywhere fall below the dew point, and protection against acid is thus necessary, the entire inner surfaces of the steel vessel 1 and of the connections 2–5 are covered with a layer of hard rubber 6. All the hard rubber covered inner surfaces are in addition provided with either one or two layers 7 of acid-resistant lining material.

In order to provide sufficient protection from the hot combustion gases to avoid damage to the hard rubber layer 6 and the acid-resistant lining 7, the hard rubber covered inner surfaces with their acid-resistant lining are provided, above the connections 3, with one or more layers of refractory (i.e. heat-resistant) bricks 8.

Surmounting the connection 2 there is a steel compensator 10 which surrounds the inserted tube 9 and seals the upper opening of the vessel while allowing for the thermal expansion of the inserted tube 9. In order to prevent HCl vapours from penetrating into the interior of the steel compensator 10 by way of the annular gap between the tube 9 and connection 2, which gap has a width usually of 1 to 5 mm, and preferably of 1 to 2 mm, the steel compensator 10 is provided with an inlet tube 11, through which an inert gas (for example nitrogen or air) can be introduced to force back the HCl vapours.

In the upper third of the vessel, slightly below the plane of the connections 3, two temperature sensors 12 are installed in diametrically opposite positions. In the region of these sensors 12 the temperature usually amount to 90° C. If as an exception it should at any time rise to 150° C, for example, the temperature sensors 12 automatically immediately stop the supply of fuel and thus also the supply of combustion gases to the vessel. Similarly a third temperature sensor 13 is provided in the outlet connection 4, where a temperature of 60° usually prevails. The sensor 13 interrupts the supply of combustion gases in the event of the temperature rising to 90° C, for example. The overheating of the hard rubber layer 6 and the discharge of insufficiently quenched combustion gases can thus be avoided.

In addition to a device as defined earlier, the present invention includes a method of quenching combustion gases containing hydrogen chloride, wherein the gases are supplied to the gas-admitting connection of a device according to the present invention while a quenching liquid is being injected thereinto through its three to eight inclined connections.

The following Example illustrates the invention.

EXAMPLE

A cooling device according to the present invention, as shown in the accompanying drawing, was used. It comprises a steel vessel 1 having a height of 3.60 meters and a diameter of 1.60 meters. The vessel's height-to-diameter ratio was therefore 2.25:1. The vessel had an approximate capacity of 7 cubic meters. It had an inserted tube 9 of corrosion-resistant steel having a diameter of 58.5 cm. There was an annular gap of 1 to 2 mm between the tube 9 and the internal lining of the gas-admitting top connection 2. At a height of 2.90 meters the vessel 1 had four lateral inclined connections 3, disposed at uniform 90° intervals, each accommodating a downwardly and inwardly directed nozzle. At a height of 2.70 meters two temperature sensors 12 were disposed in diametrically opposite positions. The lateral outlet connection 4 together with the temperature sensor 13 was situated at a height of 70 cm.

2250 $Nm^3/h$ of combustion gases, consisting of 82 volume % of inert gases (principally $N_2$ and $CO_2$), 4.0 volume % of HCl, 13 volume % of water vapour, and 1 volume % of $O_2$ were admitted into the vessel 1 from above through the tube 9, at an approximate temperature of 1000° C, and were quenched therein to 60° C with a total of 20 $Nm^3/h$ (=5 $Nm^3/h$ per nozzle) of 30 weight % hydrochloric acid at a temperature of 17° C. 100 $Nm^3/h$ of nitrogen or air were introduced through the tube 11 into the interior of the steel compensator 10, and penetrated into the vessel 1 through the annular gap around the tube 9. The combustion gases cooled to 60° C left the vessel 1 through the connections 4 and 5 together with the hydrochloric acid, which had been heated to 47° C as a result of the quenching. In an absorption cooler connected downstream of the vessel 1, the gases were cooled to 30° C, part of the water vapour being thereby condensed, and were cleaned in the usual manner. At the same time the hydrochloric acid was cooled to 17° C. Thereafter, being diluted with a total of 340 kg/h of water (condensate and added water), it was pumped back in a recycling circuit to the nozzles accommodated in the inclined connections 3, once again as 30 weight % hydrochloric acid. The excess of hydrochloric acid, i.e. the portion exceeding 20 $Nm^3/h$ (486 kg/h), was drawn off, for use elsewhere.

In this quenching procedure, the 146 kg/h of HCl contained in the 2250 $Nm^3/h$ of combustion gases, together with the 340 kg/h of water, supplied 486 kg/h of 30 weight % hydrochloric acid.

We claim:

1. A cooling device suitable for use in the quenching of combustion gases containing hydrogen chloride, which device comprises: an elongated steel vessel having rounded end portions, these being, in reference to the orientation of the vessel when it is in use, top and bottom end portions; a generally axial gas-admitting connection provided on the top end portion of the vessel; three to eight inclined connections disposed at substantially uniform angular intervals around a substantially horizontal zone situated in the top third of the vessel, below the rounded top end portion, which connections, in use, receive nozzles for the injection of a quenching liquid circulated around a closed circuit; a lateral connection in the lower third of the vessel, above the rounded bottom end portion, providing, in use, an outlet for quenched combustion gases and quenching liquid; a generally axial connection provided on the bottom end portion of the vessel, whereby assembly, repair, and cleaning operations are facilitated and/or an outlet is provided, in use, for quenching liquid; a hard rubber layer extending over the inner surfaces of the vessel and of the three to eight inclined connections and of the three other connections; an acid-resistant lining within the hard rubber layer; a refractory lining of heat insulating-bricks within the acid-resistant lining in the region above the three to eight inclined connections; a tube of corrosion-resistant steel inserted into the connection on the top end portion of the vessel; a steel compensator surrounding this inserted tube and surmounting the connection on the top end portion, whereby a seal is provided at that end of the vessel and compensation is provided for thermal expansion of the said inserted tube; and an inlet pipe connected to the steel compensator whereby, in use, an inert gas protecting its inner surface against corrosion can be admitted.

2. A device as claimed in claim 1, in which the said acid-resistant lining, below the said inclined connections, comprises a double layer of ceramic liner plates laid in acid-resistant mortar.

3. A device as claimed in claim 1, in which the said acid-resistant lining, in and above the said zone, consists of a single layer of ceramic pieces laid in acid-resistant mortar.

4. A device as claimed in claim 1, in which the said refractory lining comprises heat-insulating bricks laid in refractory mortar, and has a maximum thickness in the rounded region of the vessel which is situated, in use, above the said inclined connections.

5. A device as claimed in claim 1, in which the vessel has a height-to-diameter ratio of 1.5:1 to 3:1.

6. A device as claimed in claim 1, in which, in the top third of the vessel, there are disposed, beneath the zone of the said inclined connections, two temperature sensors, the arrangement being such that the supply of combustion gases to the vessel is interrupted in the event of the temperature sensed by either sensor exceeding a predetermined temperature in the range of 100° to 200° C.

7. A device as claimed in claim 1, in which a temperature sensor is disposed in the said lateral connection, the arrangement being such that the supply of combustion gases to the vessel is interrupted in the event of the temperature sensed by this sensor exceeding a predetermined temperature in the range of 70° to 140° C.

* * * * *